United States Patent [19]

Barton

[11] 4,238,846

[45] Dec. 9, 1980

[54] TIMING DEVICE

[76] Inventor: Lyndon O. Barton, 26 Shull Dr., Newark, Del. 19711

[21] Appl. No.: 77,561

[22] Filed: Sep. 21, 1979

[51] Int. Cl.[3] ..... G04F 1/04; G04F 3/00

[52] U.S. Cl. ..... 368/93; 368/95; 368/96

[58] Field of Search ..... 58/144 R, 145 D, 2 R, 58/127 R

[56] References Cited

U.S. PATENT DOCUMENTS

| | | | |
|---|---|---|---|
| 1,281,944 | 10/1918 | Gray | 58/144 |
| 2,122,351 | 6/1938 | Morris | 58/144 |
| 2,984,064 | 5/1961 | Bussell et al. | 58/144 |
| 3,101,587 | 5/1963 | Patrick | 58/144 |
| 3,984,110 | 10/1976 | Eckert | 58/144 X |

FOREIGN PATENT DOCUMENTS

| | | | |
|---|---|---|---|
| 50095 | 10/1911 | Austria | 58/144 |
| 948324 | 7/1949 | France | 58/144 |
| 1547692 | 6/1979 | United Kingdom | 58/144 D |

*Primary Examiner*—Vit W. Miska

[57] ABSTRACT

The timing device is one in which two float-type timers, a frame, and an angular base are adapted to measure and control playing time in games such as Scrabble, chess, checkers, and the like.

3 Claims, 4 Drawing Figures

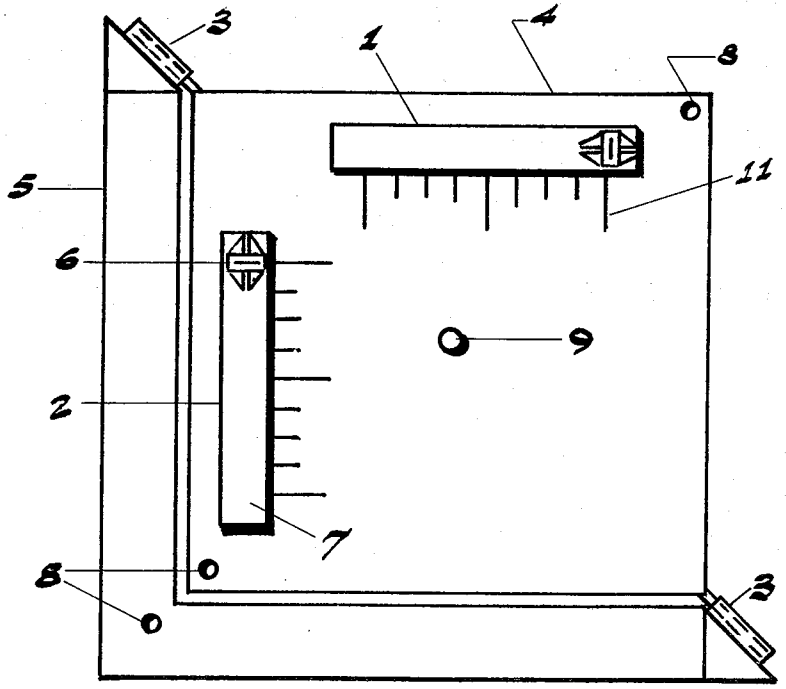
FIG. 1B - TIMER B IN USE
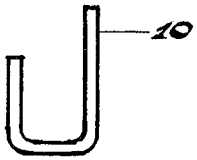
FIG. 3 - LOCKING PIN
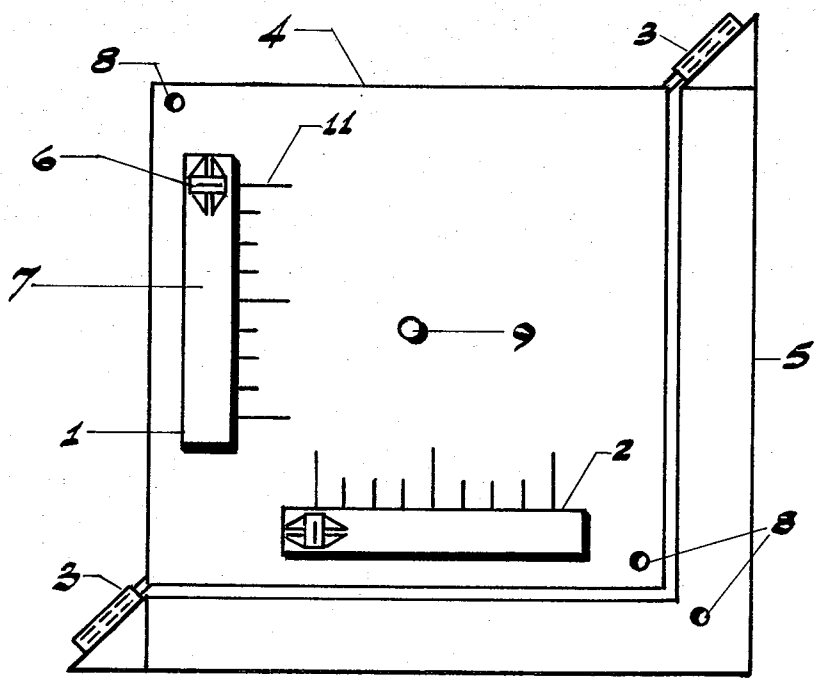
FIG. 1A - TIMER A IN USE
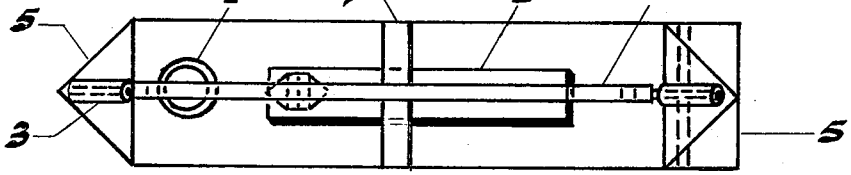
FIG. 2 - PLAN

TIMING DEVICE

BACKGROUND IN INVENTION

The object of this invention is to provide a timing device which can be used to measure and control playing time in concentration games such as Scrabble, chess, checkers and the like. Specifically, this device will allot each player an equal amount of time for the game (for example, thirty minutes for a one hour game), and also keep track of the accumulated times consumed by each player during the course of the game. Alternatively, the object is to provide the faster player the advantage of conserving more playing time than his or her opponent for later use, if needed.

SUMMARY OF INVENTION

The time device comprises two float-type timers, a simple frame in which both timers are arranged perpendicularly to each other, a right angular base, and a securing device to hold both frame and base together.

Timers are alternately actuated simply by rotating the base alternately from one side to the other.

The device has no moving mechanical parts. Stopping or resetting of both timers is accomplished by simple one-step operations in which there is virtually no risk of malfunction.

BRIEF DESCRIPTION OF THE FIGURES

FIG. 1*a* shows Timer A, 1, in use
FIG. 1*b* shows Timer B, 2, in use
FIG. 2 shows plan view of timing device
FIG. 3 shows detail of locking pin

DESCRIPTION OF THE PREFERRED EMBODIMENT

Operation:

In the orientation shown in FIG. 1*a*, Timer A, 1, is set to time Player A, while Timer B, 2, is at rest being horizontal. Timer A, 1, therefore runs until Player A completes his move or play, whereupon he rotates the base 5 for unit to assume the orientation in FIG. 1*b*. This automatically stops Timer A, 1, and starts Timer B, 2, (or Player B's timer). The process continues with each player taking turn until both timers (or the alloted times) run out.

In the event of a game interruption - situation that normally arises during a game of Scrabble, when a played word is challenged and has to be checked - the timing device is laid flat so that both timers 1 and 2 are idle during that period.

To reset timers 1 and 2, the frame 4 is released from the base 5, rotated through an angle of one-hundred-and-eighty degrees, and then re-secured to the base 5.

PREFERRED EMBODIMENT

The accompanying drawings are a representation of the preferred embodiment of the timing device invention.

The timers 1 and 2 are identical float-type devices, as described in U.S. Pat. No. 2,714,927. In a float-type device, time is measured based on the rate at which a float sinks in a viscous liquid when acted upon by gravity. In this case, the viscous liquid 7 is a silicone fluid, similar to Dow Corning DC 200, whose viscosity is stable over a wide range of room temperatures, and the float 6 is a plastic whose density is slightly greater than that of the liquid.

The timers 1 and 2 are arranged at right angles to each other in a rectangular frame 4 so that during normal operation the float in one timer is horizontal and stationary while the other is vertical and under the influence of gravity.

Timers 1 and 2 are not size restrictive, nor are they type restrictive. They can be conveniently sized depending on the time period desired for the game, and they can be another form of fluid timer such as the hour-glass type, granular or liquid.

The float-type timer provides greater precision and affords more design flexibility.

Timers 1 and 2 are calibrated to measure elapsed times for individual plays, using graduation marks 11 shown.

Frame 4 is hinged and secured to a right angular or L-shaped base 5 having one leg horizontal and the other leg vertical. Frame 4 is also arranged so that one timer is parallel to the horizontal leg and the other timer is parallel to the vertical leg. Thus, when the base 5 is rotated clockwise or counterclockwise from one leg to the other, the timer parallel to the vertical leg moves to horizontal position and s tops while the timer parallel to the horizontal leg moves to a vertical position and is started. The right angular base 5 is to restrict the timers 1 and 2 to just two operative positions, and thus avoid possibility of timer malfunction.

The hinges 3 which attach frame 4 to the base 5 are located at both ends of the base 5 along a common diagonal to permit rotation of frame 4 about the diagonal. Timers 1 and 2 can be reset for start of new game by switching the unhinged corners of the frame 4. Note that the frame rotation is in a plane that is normal or perpendicular to that in which the timers 1 and 2 are mounted. Alternatively, the frame 4 can be attached to the base 5 such that it can be indexed or rotated in the same plane in which the timers 1 and 2 are mounted.

The hinged method is preferred for precision and simplicity.

The pegs 9 on the frame 4 permit the timing device to assume a horizontal or neutral position when laid on a horizontal surface. The holes 8 provided in the frame 4 and the support base 5 are for use of a "U" shaped locking pin 10 to secure the frame 4 to the base 5 so that both can move together as an integral unit. Note that the securing device can be a locking pin or an equivalent mechanical fastening device.

Except as noted, all components of the timing device can be constructed from plastic, wood, glass, metal such as aluminum, or a combination thereof.

While the above description is at present considered to be a preferred embodiment of this invention, it will be obvious to those skilled in the art that various changes and modifications may be made therein without departing from the invention, and that it is the intent of said embodiment to cover all such changes and modifications that fall within the true spirit and scope of the invention.

What is claimed is:

1. A timing device comprising a hinged frame on which are mounted two gravity actuated timers, arranged perpendicularly to each other, a right angular base having one leg vertical and the other leg horizontal, and a securing device to measure and control playing time in concentration games such as Scrabble, chess, checkers, and the like, wherein;

a. said frame is arranged with respect to said base such that one timer is parallel to the horizontal leg of said base, and the other timer parallel to the vertical leg of said base, b. said frame is hinged to both ends of said base along a common diagonal such that it is rotatable within said base about said diagonal, c. said frame is held to said base, using said securing device, such that both frame and base are movable as an integral unit, d. said base is rotatable either clockwise or counter-clockwise, in the vertical plane from one leg to to the other.

2. The timing device of claim 1, wherein the frame is rectangular in shape.

3. The timing device of claim 1, wherein the securing device is a "U" shaped locking pin.

* * * * *